US010438768B2

(12) United States Patent
Olsen

(10) Patent No.: US 10,438,768 B2
(45) Date of Patent: Oct. 8, 2019

(54) X-RAY SYSTEMS AND METHODS INCLUDING X-RAY ANODES WITH GRADIENT PROFILES

(71) Applicant: Neil Dee Olsen, Bountiful, UT (US)

(72) Inventor: Neil Dee Olsen, Bountiful, UT (US)

( * ) Notice: Subject to any disclaimer, the term of this patent is extended or adjusted under 35 U.S.C. 154(b) by 0 days.

(21) Appl. No.: 16/141,676

(22) Filed: Sep. 25, 2018

(65) Prior Publication Data

US 2019/0027337 A1 Jan. 24, 2019

Related U.S. Application Data

(63) Continuation-in-part of application No. 15/441,938, filed on Feb. 24, 2017, which is a continuation-in-part of application No. 15/220,158, filed on Jul. 26, 2016, now Pat. No. 10,032,598.

(51) Int. Cl.
*H01J 35/00* (2006.01)
*H01J 35/10* (2006.01)

(52) U.S. Cl.
CPC ..... *H01J 35/108* (2013.01); *H01J 35/101* (2013.01)

(58) Field of Classification Search
CPC ..... H01J 2235/081; H01J 35/10; H01J 35/08; H01J 35/101; H01J 35/108
See application file for complete search history.

(56) References Cited

U.S. PATENT DOCUMENTS 4,090,103 A * 5/1978 Machenschalk ..... H01J 35/105 252/520.2
4,184,097 A * 1/1980 Auge ..... H01J 35/06 378/140
4,870,672 A 9/1989 Lindberg
4,953,191 A 8/1990 Smither et al.
5,181,235 A 1/1993 Ono et al.
6,075,839 A 6/2000 Treseder
10,032,598 B2 7/2018 Olsen
2010/0008471 A1 1/2010 Morton
2010/0040202 A1 2/2010 Lee
(Continued)

FOREIGN PATENT DOCUMENTS

JP S56141153 11/1981
JP H0719533 3/1995

OTHER PUBLICATIONS

U.S. Appl. No. 15/220,158, Non-Final Office Action dated Apr. 25, 2018.

(Continued)

*Primary Examiner* — Dani Fox

(74) *Attorney, Agent, or Firm* — Phillips, Ryther & Winchester; Justin K. Flanagan

(57) ABSTRACT

An anode for an X-ray tube can include one or more of an yttrium-oxide derivative, titanium diboride, boron carbide, titanium suboxide, reaction-bonded silicon carbide, and reaction-bonded silicon nitride. Upon collision with an anode, the kinetic energy of an electron beam in an X-ray tube is converted to high-frequency electromagnetic waves, i.e., X-rays. An anode from one or more of the above materials and a gradient distribution of conductive metals can reduce costs and/or weight, extend the life of the anode or associated components (e.g., bearings) and simultaneously provide a higher heat storage capacity as compared to traditional molybdenum and tungsten anodes.

20 Claims, 11 Drawing Sheets

(56) References Cited

U.S. PATENT DOCUMENTS

| | | | |
|---|---|---|---|
| 2014/0211919 | A1 | 7/2014 | Ogura |
| 2018/0033583 | A1 | 2/2018 | Olsen |
| 2018/0033584 | A1 | 2/2018 | Olsen |

OTHER PUBLICATIONS

U.S. Appl. No. 15/220,158, Notice of Allowance dated Jun. 20, 2018.

* cited by examiner

X-RAY SYSTEMS AND METHODS INCLUDING X-RAY ANODES WITH GRADIENT PROFILES

RELATED APPLICATIONS

This application claims priority as a continuation-in-part to U.S. patent application Ser. No. 15/441,938 filed on Feb. 24, 2017, titled "X-RAY SYSTEMS AND METHODS INCLUDING X-RAY ANODES," which is a continuation-in-part of U.S. Pat. No. 10,032,598 which was granted on Jul. 24, 2018 and originally filed on Jul. 26, 2016 as U.S. patent application Ser. No. 15/220,158, titled "X-RAY SYSTEMS AND METHODS INCLUDING X-RAY ANODES," which applications are both hereby incorporated by reference their entireties.

TECHNICAL FIELD

The present disclosure relates generally to X-ray systems including X-ray anodes of X-ray tubes. More specifically, the present disclosure relates to an anode with a ceramic body having a gradient profile.

BACKGROUND

X-ray beam generating devices, or X-ray tubes, typically comprise dual electrodes of an electrical circuit within an evacuated chamber or tube. The electrical circuit generates a beam of electrons, which are emitted by a cathode and accelerated across a potential difference toward an anode target. The electrons collide with the anode target resulting in energy that is emitted as an X-ray. One of the problems frequently encountered with anodes is that the material from which they are formed must be able to withstand high temperatures and repeated operation. The materials commonly utilized to form X-ray anodes are heavy and relatively expensive metals.

BRIEF DESCRIPTION OF THE DRAWINGS

The written disclosure herein describes illustrative embodiments that are non-limiting and non-exhaustive. Reference is made to certain of such illustrative embodiments that are depicted in the figures described below.

DESCRIPTION

Figure 1:
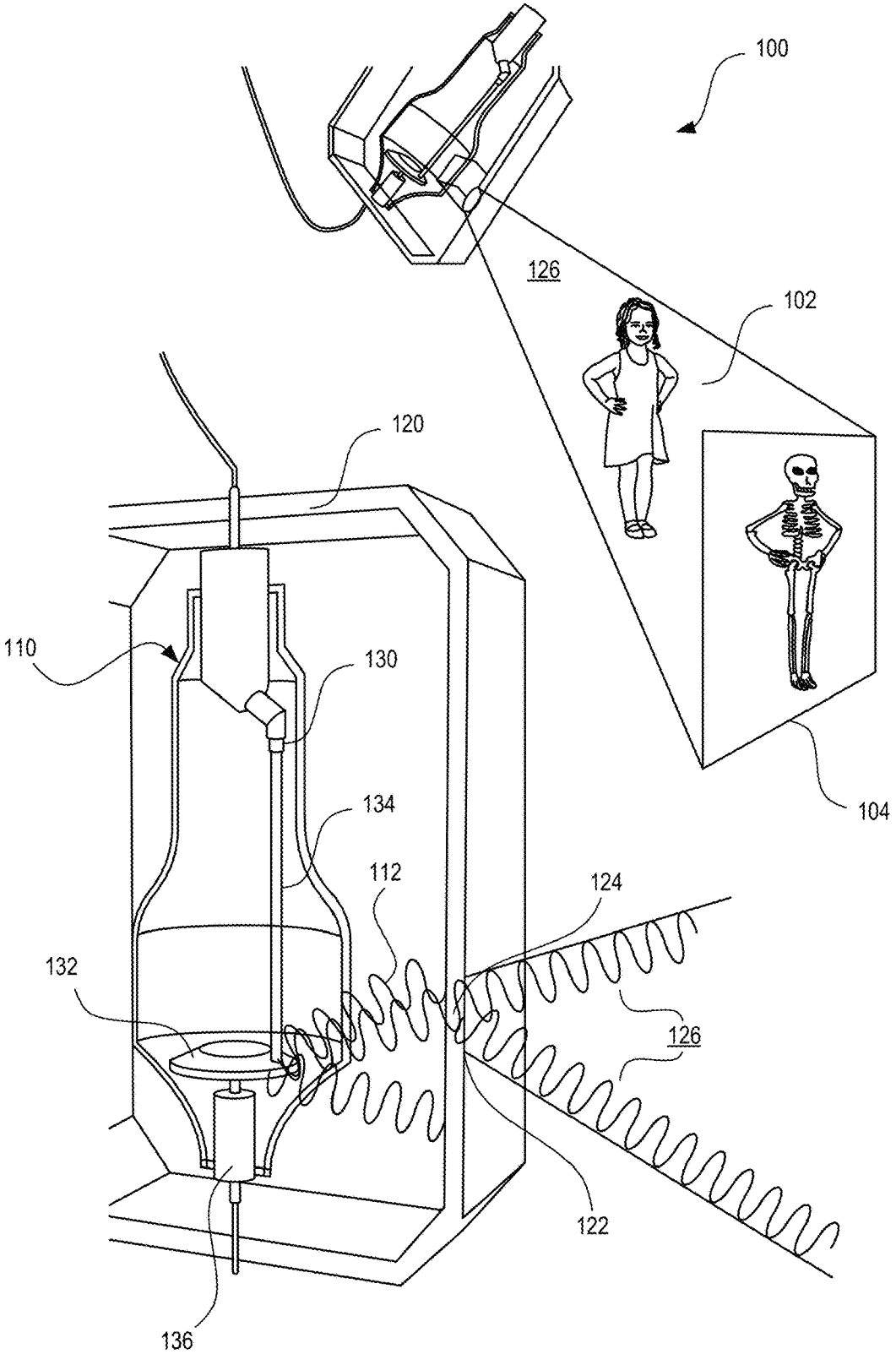
FIG. 1 illustrates an X-ray beam generating system, with a cross-sectional view of an X-ray tube.

An X-ray anode emits X-rays when it is in a thermally excited state in response to incident electrons from an electron beam. Metals that have the necessary properties to act as X-ray anodes are heavy and expensive. The inclusion of ceramic bodies in X-ray anodes reduces their weight and cost. For at least a first temperature range, the X-ray anode may increase in thermal conductivity with increased temperature. That is, as the temperature of the X-ray anode increases, the thermal conductivity increases. In one embodiment, the X-ray anode may be a yttrium-based ceramic that is a poor conductor (electrically and/or thermally) at ambient temperatures. However, as the temperature of the yttrium-based ceramic anode increases, the thermal and/or electrical conductivity increases. As such, while an ambient temperature yttrium-based ceramic anode may not provide a suitable anode for an X-ray system, a heated yttrium-based ceramic anode may provide a suitable anode for an X-ray system.

Similarly, one or more of titanium diboride, boron carbide, titanium suboxide, reaction-bonded silicon carbide, and reaction-bonded silicon nitride may also have temperature-dependent electrical conductivity. The temperature-dependent conductivity may vary based on composition; therefore, a target thermal profile may be achieved by, for example, increasing or decreasing the amount of carbon in a boron carbide anode.

In some embodiments, a lithium ion conductive glass ceramic, or LIC-GC®, may be used as a base material for the anode, or as a conductive layer to another base material described herein. In some embodiments, LIC-GC® may be used in place of metals or other doping materials according to any of the various embodiments described herein. For example, a yttrium-based ceramic anode (or other material such as titanium diboride, boron carbide, titanium suboxide, etc.) may utilize a layer of LIC-GC® as a coating or sandwiched layer. In other embodiments, a ceramic anode of the various types described herein may include spirals or radial lines of LIC-GC® in place of metal, as is described in various embodiments herein.

Many of the examples provided herein relate to yttrium-based ceramic anodes. However, it is appreciated that in many instances, the X-ray anode may be made from or additionally include titanium diboride, boron carbine, titanium suboxide, and/or a reaction-bonded silicon carbide or nitride. In some embodiments, one or more of these materials may be a coating on a base material of another types.

In various embodiments, an anode may include one or more conductive metal wires thermally coupled to the ceramic body to receive a plurality of incident electrons from the electron beam. During operation, the received plurality of incident electrons increases the thermal energy in the conductive metal wires, and the conductive metal wires diffuse the increase in thermal energy to the ceramic body, such that the temperature of the ceramic body increases as does the thermal conductivity of the ceramic body for at least the first temperature range (e.g., ambient temperature to sub-2,500-degree Celsius temperatures).

In various embodiments, the X-ray anode comprises yttrium aluminum garnet. In a thermally unexcited state, such as temperatures in a range below 100 degrees Celsius, the X-ray anode may be a poor conductor. However, in a thermally excited state, such as a temperature range above 150 degrees Celsius, the X-ray anode may be a good conductor. Notably, in some embodiments, a range of temperatures corresponding to a transition state may separate the unexcited state from the thermally excited state. In other embodiments, the transition state may be less than degree based on the distribution of materials in the X-ray anode.

The temperature range of the unexcited state may vary based on the exact composition of the X-ray anode. For example, the unexcited state of four different embodiments of X-ray anodes may correspond to temperature ranges bounded by four different temperature thresholds temperatures such that the ranges are, respectively, those below 75 degrees Celsius, those below 100 degrees Celsius, those below 125 degrees Celsius, and those below 150 degrees Celsius. The thermally excited state of each of the X-ray anodes in the preceding example correspond to temperatures above the four temperature values. That is, the thermally excited state of each of the example X-ray anodes may correspond to temperatures above 75 degrees Celsius, 100 degrees Celsius, 125 degrees Celsius, and 150 degrees Celsius.

In such embodiments, the X-ray anode can be described as in one of two states: unexcited and thermally excited. The transition from poor conductor to good conductor may be a high-order exponential function of temperature, such that a graph of conduction relative to temperature approximates a step or piecewise function.

In other embodiments, the X-ray anode may have wide range of temperatures at which conduction is increasing with temperate according to a lower-order function. In the context of the four X-ray anodes embodiments described above, the thermally excited states may correspond to, for example, temperatures above 150 degrees Celsius, above 120 degrees Celsius, above 130 degrees Celsius, and above 300 degrees Celsius, respectively.

In various embodiments, conductive metal wires may extend radially out relative to the ceramic body. In some embodiments, conductive metal wires may form a spiral beginning at or near a center of the ceramic body and ending at or near the edge of the ceramic body. In some embodiments, the spiral tightens proximate the location where the electron beam strikes the anode. The conductive metal wires may be partially contained within the ceramic body. The conductive metal wires may be exposed proximate a location at which the electron beam strikes the X-ray anode.

In various embodiments, conductive metal is combined with the ceramic body to form a composite gradient (e.g., density profile, decreasing or increasing gradient distribution, or the like) of metal and ceramic material. In one embodiment, the surface proximate the location where the electron beam strikes is primarily and/or entirely composed of metal while the opposite surface is primarily and/or entirely composed of ceramic. The metal conducts heat into the ceramic material that in turn conducts thermal energy after being sufficiently heated.

In some embodiments, metal and ceramic are combined to form a composite gradient where the gradient varies from primarily and/or entirely metal material at the focal track, where the electron beam impacts the surface of the anode, to primarily and/or entirely receive the electron beam. The percentage of ceramic material may increase with respect to the distance from the track in all directions. This embodiment reduces the use of metal where its conductive properties do little to heat the surrounding ceramic material.

There are many manufacturing techniques that can be used to create X-ray anodes comprising composite gradients of ceramic and metal. Three techniques are described, but these techniques do not represent an exhaustive list of possible approaches.

The first technique combines ceramic casting, machining, etching, and/or 3-D printing with metal pouring and/or deposition. A ceramic substrate can be cast, machined, etched, and/or printed so that when metal is poured and/or deposited on the ceramic surface, the ratio of metal to ceramic is highest near the refractory surface and decreases at locations farther away. One such embodiment comprises concentric v-shaped tracks cast, machined, etched, and/or printed into a ceramic body. These tracks are then filled with metal. The surface proximate the top of the v-shaped tracks will have a higher ratio of metal to ceramic than near the bottom of the v-shaped tracks.

Another technique combines powder or micro-powder forms of the chosen materials in the proper ratio with and/or without a melting, sintering, and/or annealing period between layers. At the layer proximate to where the electron beam strikes the anode, metal would be primarily and/or exclusively deposited. After this layer is processed, the next layer is appropriately mixed and processed until the final layer of primarily and/or exclusively ceramic material is added and processed.

A third technique combines liquids of the chosen materials in the proper ratio with and/or without a cooling period between layers. In other words, both the ceramic and metal can be melted, poured together in the desired ratio, and allowed to cool sufficiently before the next layer is poured.

As described herein, an aperture may be formed through the anode to allow for a shaft to be connected to the X-ray anode. Rotation of the shaft may cause the anode to rotate during operation. In one embodiment, the ceramic body comprises yttrium oxide. In one embodiment, the ceramic body consists of exclusively yttrium oxide. In one embodiment, the ceramic body consists of exclusively yttrium oxide with doped metals, plated metals, or metal wires added thereto. In one embodiment, the ceramic body consists of exclusively yttrium oxide and added metals to form a composite gradient of material.

The X-ray anode may include a metal backing. The metal backing may be used to balance the anode for rotation. In some embodiments, instead of or in addition to one or more doped metals or integrated conductive wires, an anode may include a conductive coating or layer. In some embodiments, an anode may comprise a composite of two or more ceramics and/or a composite of a non-conductive material together with a conductive material. In some embodiments, a two-part design such as molybdenum and tungsten sandwiched together may also be used and/or a composite of molybdenum and tungsten may be used.

It will be readily understood that the components of the embodiments as generally described and illustrated in the figures herein could be arranged and designed in a wide variety of different configurations. Thus, the following more detailed description of various embodiments, as represented in the figures, is not intended to limit the scope of the present disclosure but is merely representative of various embodiments. While the various aspects of the embodiments are presented in drawings, the drawings are not necessarily drawn to scale.

In the following disclosure, an "anode" may also be referred to as an "X-ray tube anode" or "X-ray anode" and may contextually refer to the anode body or a target portion of an anode that is struck by electrons from the cathode. In various embodiments, the anode may be a "ceramic" or a "crystalline ceramic" anode. An X-ray target and an X-ray anode may be used interchangeably as can be contextually understood when the discussion directly relates to the region of an X-ray anode specifically impinged with electrons from an electron beam.

The phrases "connected to" and "coupled to" are used in their ordinary sense and refer to any suitable coupling or other form of interaction between two or more entities, including mechanical, fluid, and thermal interaction. Two components may be connected to each other even though they are not in direct contact with each other.

X-ray tubes may be used to convert electrical input power into X-rays. Within an X-ray tube, a cathode may emit electrons into a vacuum. An anode target may collect the electrons, thus forming an electrical current or electron beam inside the X-ray tube. Upon collision with an anode target, the kinetic energy of the electron beam is converted to high-frequency electromagnetic waves, i.e., X-rays. In some embodiments, the X-rays may be collimated and focused for penetration through an object for internal examination purposes.

Within an X-ray tube, the high velocity electron beam that impinges on an anode target surface can generate extremely high and localized temperatures within or on the anode structure. High temperatures within or on the anode structure may induce high internal stresses. The high internal stresses can lead to deterioration and breakdown of the anode, especially a target portion of the anode (i.e., an electron impact region of the anode). In various embodiments, a rotating anode may be used. A rotating anode may include a disc-like structure supported by a shaft, one side or face of which is exposed to the electron beam from a thermionic emitter cathode. By means of anode rotation, the impinged region of the target is continuously changing to avoid localized heat concentration and stresses, and to better distribute the heating effects throughout the anode structure. Increased rotation of an anode may improve heat dissipation and radiation. Accordingly, rotation speeds may be between 1,000 rotations per minute (rpm) and 30,000 rpm. For example, an anode may be rotated at 10,000 rpm. A motor or other electromechanical rotational device may rotate a shaft connected to a center of an anode. For example, an induction motor, which includes a stator housed outside the X-ray tube and a rotor located within the X-ray tube, may be connected to the shaft to stimulate shaft rotation.

The composition of an anode may include any material or combination of materials that can withstand the temperatures induced by the electron beam emitted by the cathode and also emit X-rays. The anode may transfer heat to the X-ray tube or envelope structure. The heat storage capacity of the anode body may be relatively high to account for a relatively inefficient heat transfer from the anode to the X-ray tube or envelope structure.

In one embodiment, only approximately 1.0% of the energy of the impinging electron beam is converted to X-rays with the remainder appearing as heat that must be absorbed and/or dissipated from the anode essentially by means of heat radiation. The temperature of any single incident point on the focal track of the electron beam can exceed 2,500 degrees Celsius. In addition, the material may be configured with sufficient ductility to withstand conditions of repeated operation. Accordingly; some anodes include a large percentage of graphite, which has a high heat storage capacity and readily accepts bonding of a refractory metal cover or surface. In other embodiments, anodes can be mostly or completely composed of refractory metal. The target region of the anode can be of a separate material from the anode body, or the material of the entire anode can be homogenous throughout. The anode target that is exposed to the impinging electron beam often includes copper, iron, silver, chromium cobalt, tungsten, molybdenum, and/or their alloys.

Anodes may be disc-like in shape, with a topmost surface that is directed toward the cathode and a flat base facing opposite the cathode. The topmost surface may include a beveled edge, with the center of the anode generally being thicker in depth than the periphery of the anode, and the topmost surface sloping down from the center towards the edges of the anode. The center of an anode may include a cavity through which a shaft connected to a rotating motor can penetrate.

An anode body can include multiple layers of material, or have a solid body encased or plated with an alternative material, such as a refractory metal. Of course, the specific shape, size, bevels, flat surfaces, and/or curved surfaces may be modified for a specific application based on design choice. The construction techniques, arrangements, compositions, and materials described herein may be suitable for a wide variety of anodes having various shapes and sizes.

Within an X-ray tube, the combination of elevated temperatures with the high rotational speed of an anode leads to the generation of severe stresses on the anode. These stresses can result in deterioration and/or structural failure of the anode body, the anode target, or other components of the X-ray tube, such as bearings associated with rotation of the anode. Replacement of an anode can be burdensome due to the nature of the anode materials. According to various embodiments of the present disclosure, a high-flux X-ray tube configuration is provided that includes an anode with sufficient heat dissipation and life expectancy that simplifies the manufacturing process, may be cheaper, and may produce a lighter than an anode manufactured from refractory metals.

Anode bodies for X-ray tubes that have high percentages of graphite and/or refractory metal necessary for functionality can be heavy and/or expensive. Accordingly, various embodiments disclosed herein provide alternative materials for an anode body that reduces the burden of replacing an anode by limiting the costs and/or weight, while simultaneously maintaining a high heat storage capacity for proper heat dissipation. According to various embodiments of anode bodies disclosed herein, the anodes may provide improved reliability and extended life expectancy.

Certain ceramics have an electrical insulating quality, provide heat-resistance, and are robust. Crystalline ceramics can provide sufficient heat dissipation for an X-ray tube and include components capable of maintaining an extended life with a limited introduction of cost and manufacturing complexity. In one embodiment, transparent crystalline ceramics, such as yttrium-oxide derivatives, are included in the material composition of an anode for an X-ray tube. Specifically, yttrium aluminum oxide, also known as yttrium aluminum garnet, may be utilized to form an anode. As previously noted, other material(s) that can be used in place of or in combination with yttrium (e.g., yttrium aluminum oxide and/or yttrium aluminum garnet) to form an anode include titanium diboride, boron carbide, titanium suboxide, reaction-bonded silicon carbide, and reaction-bonded silicon nitride.

FIG. 1 is a representation of an X-ray beam-generating system 100, according to one embodiment, with a sectional view of the X-ray tube assembly 110. The X-ray beam-generating system 100 includes a thick lead case 120 to control X-ray radiation. The X-rays 112 may escape the X-ray tube assembly 110 via a small window 122 in the lead case 120. That is, the small window 122 lets some of the X-rays 112 escape from the X-ray beam-generating system 100. In some embodiments, X-rays 112 may pass through one or more filters 124. In some embodiments, the X-rays 112 are directed towards a human subject 102 in the form of an X-ray beam 126. The X-ray beam 126 may be used to penetrate visually opaque objects, such as a human subject 102, and produce a radiograph 104, often referred to as an X-ray image, of a subject 102.

The X-ray beam-generating system 100 includes an X-ray tube assembly 110 where a heated filament or cathode 130 emits electrons in the form of an electron beam 134 into the X-ray tube assembly 110 and an anode 132 collects the electrons. The X-ray tube assembly 110 may be immersed in an oil bath to absorb excess heat. A motor 136 rotates the anode 132 to avoid localized heat concentration and stresses on the anode 132. In response to the electrical input power from the electron beam 134, the anode 132 produces X-rays 112.

Figure 2:
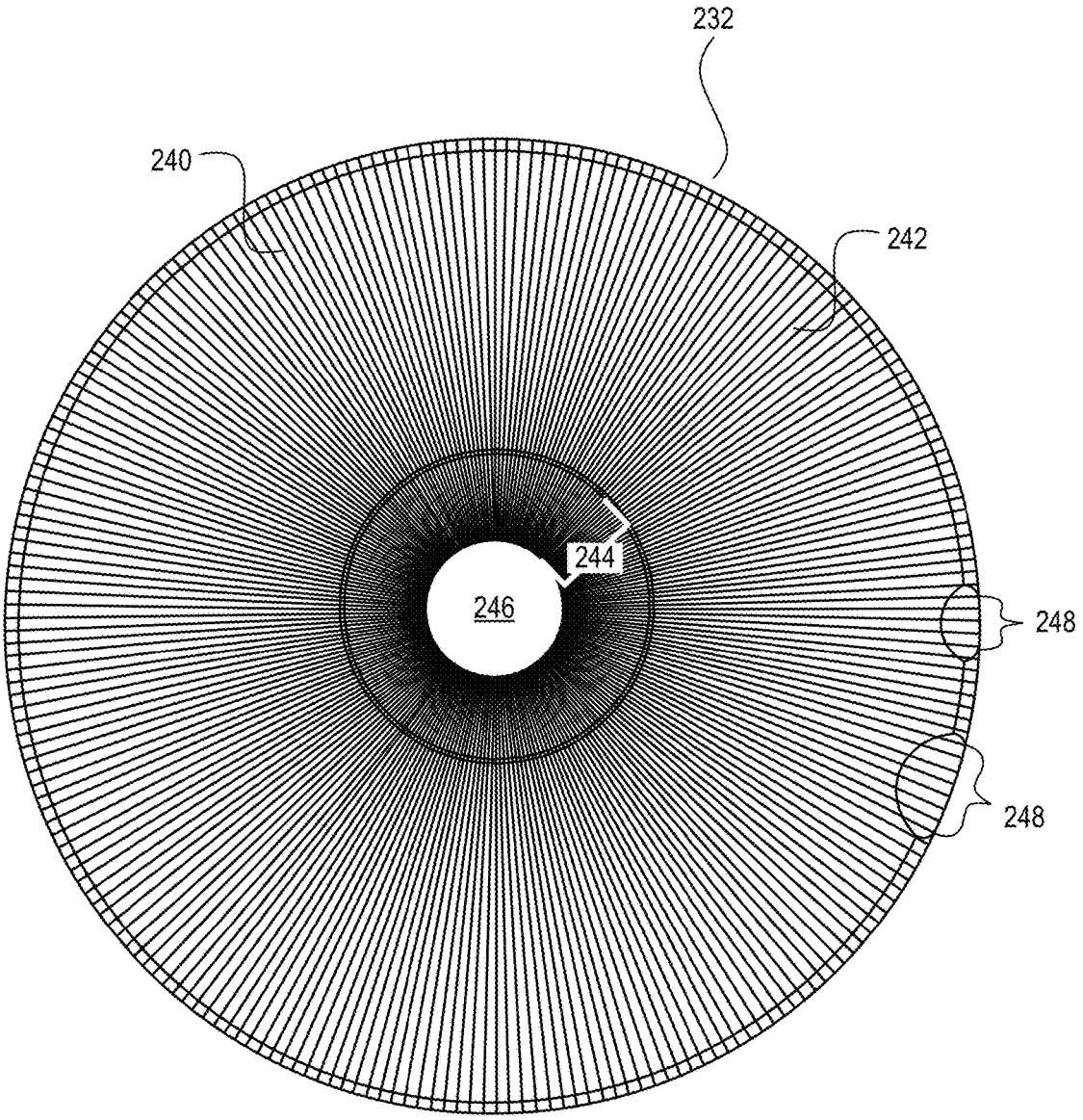
FIG. 2 is a view of the base of an anode for an X-ray tube, according to one embodiment, with metal wires extending radially from the center of the anode to a peripheral portion of the anode.

FIG. 2 is a view of the base of an anode 232 for an X-ray tube, according to one embodiment, with one or more metal wires 242 extending radially, similar to spokes of a wheel, from the center of the anode 232 to the peripheral portion of the anode 232. The anode 232 includes a crystalline ceramic body 240 in the shape of a disc, and an array of thin metal wires 242 that are connected to the crystalline ceramic body 240.

In various embodiments, the crystalline ceramic body 240 may not conduct electricity in a first, cool temperature or state. The metal wires 242 may initially distribute heat received from electrons to the crystalline ceramic body 240 to warm the crystalline ceramic body 240 to a second temperature or state in which the crystalline ceramic body 240 does conduct electricity.

The metal wires 242 are positioned radially and can collect heat from an electron beam. The metal wires 242 can include any electrically conductive metal capable of withstanding the temperatures necessary for functionality. More specifically, the metal wires 242 can consist solely of an electrically conductive metal or alloy capable of withstanding the temperatures necessary for functionality. The heat from the metal wires 242 can then be transferred and distributed to the crystalline ceramic body 240 so that the crystalline ceramic body 240 is hot enough to conduct electricity.

In the center of the anode 232 is a center cavity 246 through which a shaft connected to a motor can penetrate. A motor (see, e.g., motor 136 in FIG. 1) induces rotation of the shaft, and the shaft is connected to the anode 232 at the center cavity 246. The section of the crystalline ceramic body 240 that most closely surrounds the center cavity 246 can form an indented rim 244 around the center cavity 246 to contribute to the stability and/or functionality necessary for rotation of the anode 232. The crystalline ceramic body 240 can have one or more notches 248 forming an indentation on the outside edge of the base of the anode 232. The notches 248 can vary in depth and breadth and may be positioned so as to balance the weight of the spinning anode 232. Alternatively, a metal backing may be selectively added (or added and then notched) to balance the anode 232.

As previously noted, the anode 232 may include a crystalline ceramic body 240. In alternative embodiments, the anode 232 may include a body 240 manufactured from one or more of: titanium diboride, boron carbide, titanium suboxide, reaction-bonded silicon carbide, and reaction-bonded silicon nitride. In some embodiments, composites therefor may be utilized and/or yttrium may be used for some portions of the body 240 and one or more of titanium diboride, boron carbide, titanium suboxide, reaction-bonded silicon carbide, and/or reaction-bonded silicon nitride may be utilized as a coating, composite material, as a doping material doping, sputtering, deposition, vapor deposition etc.

Figure 3:
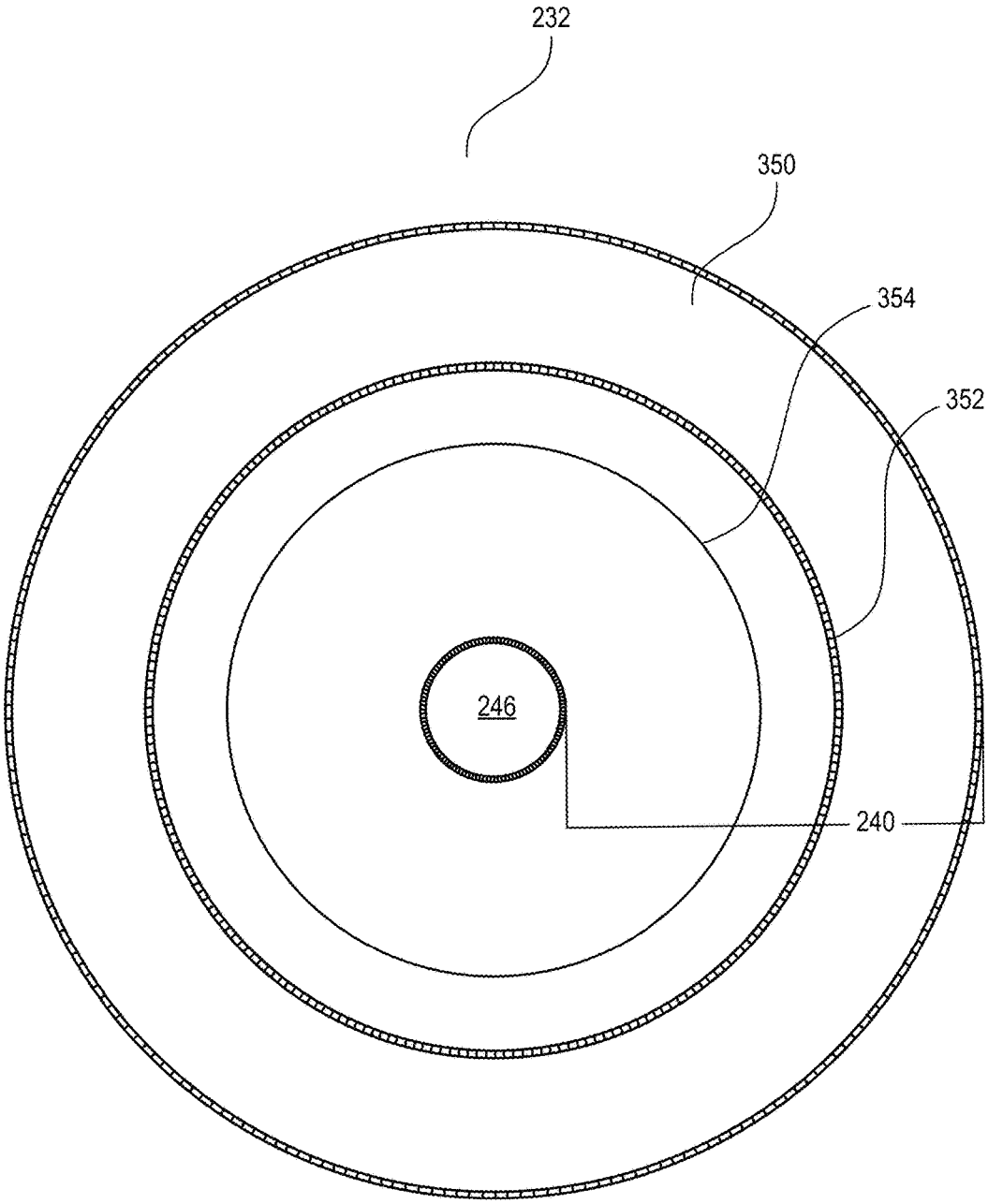
FIG. 3 is an overhead view of a topmost surface of the anode of FIG. 2.

FIG. 3 is an overhead view of the topmost surface 354 of the anode 232 of FIG. 2. The crystalline ceramic body 240 includes a beveled surface 350 that slopes down and away from the center of the anode 232 such that the depth of the crystalline ceramic body 240 is thinner at the periphery than the interior of the anode 232. The region closest to the center of the anode 232 is flat, but the surface 350 begins to slope at an inflection point 354 and continues in the sloped trajectory until the edge of the anode 232. In the center of the anode 232 is a center cavity 246 through which a shaft connected to a rotating motor can penetrate (see, e.g., motor 136 in FIG. 1).

A focal track 352 is the impact region of an electron beam as the electrons impinge the surface 350 of the anode 232 during rotation. The focal track 352 of the anode 232 can be composed of the same material as the crystalline ceramic body 240, or include a refractory metal, e.g., tungsten, that is coupled to the crystalline ceramic body 240.

Figure 4:
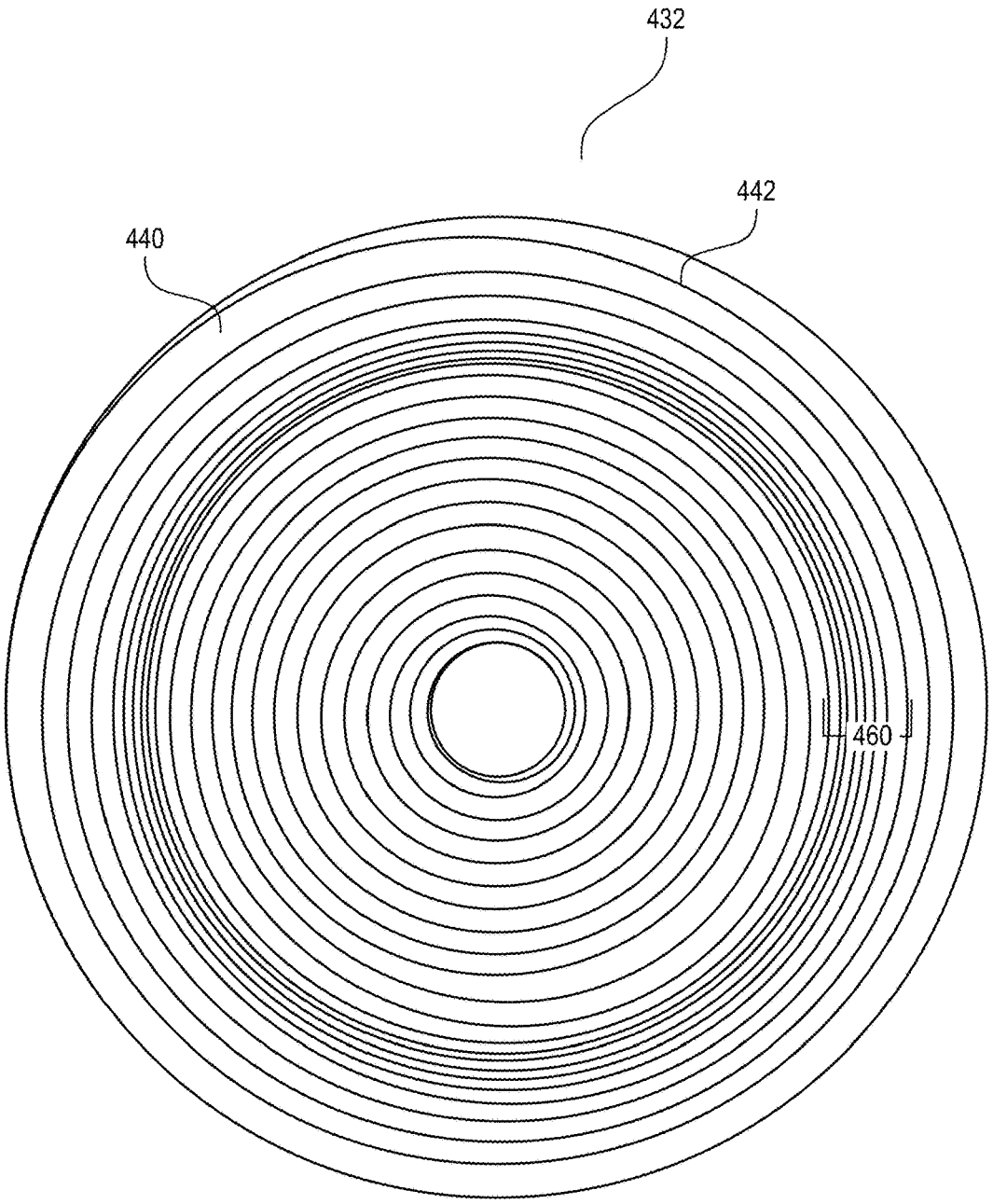
FIG. 4 is a view of a base of an anode for an X-ray tube, according to one embodiment, with a continuous metal wire that forms a spiral around the center of the anode and incrementally expands in diameter as the metal wire gets closer to a periphery of the anode.

FIG. 4 is a view of the base of an anode 432 for an X-ray tube, according to one embodiment, with a continuous metal wire 442 that forms a spiral around the center of the anode 432, and incrementally expands in diameter as the metal wire 442 gets closer to the periphery of the anode 432. The rotations of the metal wire 442 can be uniformly spaced or can have a varied spacing such that certain clusters 460 of the metal wire 442 can be tightly spiraled while other sections are spaced wider apart. The clusters 460 of metal wire 442 can be positioned at the locations of the crystalline ceramic body 440 where an electron beam typically strikes a surface of the anode 432, otherwise known as a focal track. The metal wire 442 can include any electrically conductive metal capable of withstanding the high temperatures necessary for functionality, as discussed above. The heat from the metal wire 442 can then be transferred to the crystalline ceramic body 440 so that the crystalline ceramic body 440 is hot enough to conduct electricity.

Figure 5:
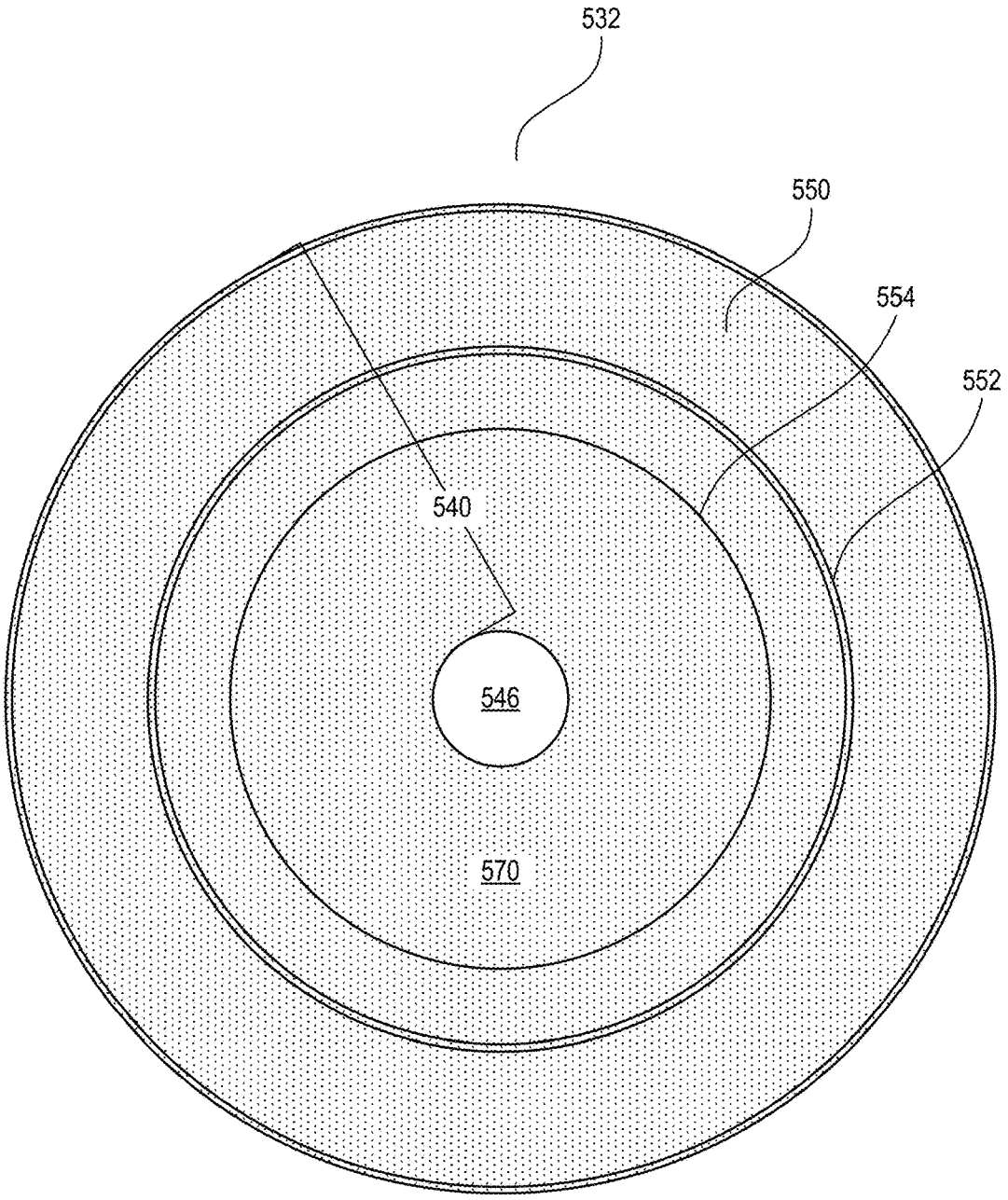
FIG. 5 is an overhead view of an anode for an X-ray tube, according to one embodiment, in which pixels distributed uniformly throughout the anode represent that the anode has been doped or infused with an electrically conductive material.

FIG. 5 is an overhead view of an anode 532 for an X-ray tube, according to one embodiment, in which pixels distributed uniformly throughout the crystalline ceramic body 540 represent that the anode 532 has been doped or infused with one or more electrically conductive materials 570. The crystalline ceramic body includes a beveled surface 550 that slopes down and away from the center of the anode 532 such that the depth of the crystalline ceramic body is thinner at the periphery than the interior of the anode 532. The region closest to the center of the anode 532 is flat, but the surface 550 begins to slope at an inflection point 554 and continues in the sloped trajectory until the edge of the anode 532. In the center of the anode 532 is a center cavity 546 through which a shaft connected to a rotating motor can penetrate (see, e.g., motor 136 in FIG. 1).

A focal track 552 is the impact region where electrons from an electron beam impinge the surface 550 of the anode 532 during rotation. The focal track 552 of the anode 532 may be manufactured of the same material as the crystalline ceramic body that is doped or infused with one or more electrically conductive material(s) 570.

Figure 6:
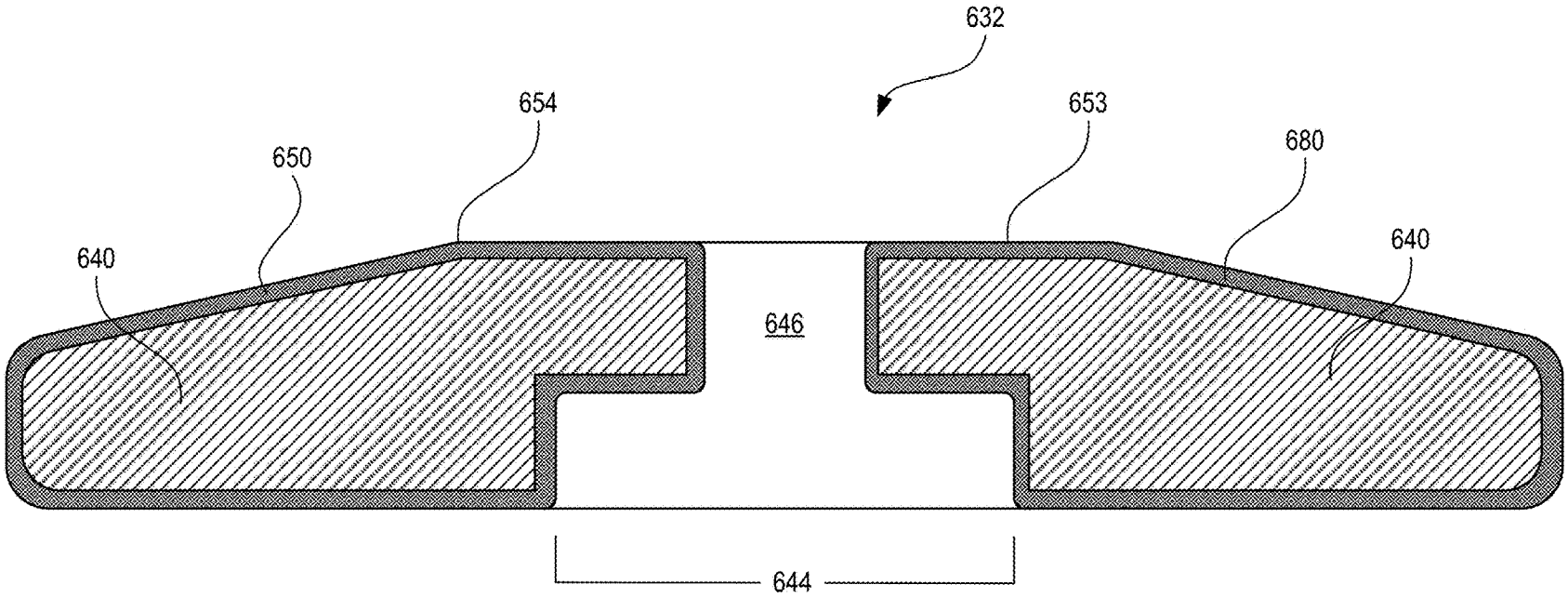
FIG. 6 is a side cross-sectional view of an anode for an X-ray tube, according to one embodiment, in which a plated layer or film of metal encapsulates the anode body.

FIG. 6 is a side cross-sectional view of an anode 632 for an X-ray tube, according to one embodiment, in which a plated layer or film 680 of metal completely encapsulates the crystalline ceramic body 640. The crystalline ceramic body 640 includes a beveled surface 650 that slopes down and away from the center of the anode 632 such that the depth of the crystalline ceramic body 640 is thinner at the periphery than the interior of the anode 632.

In all embodiments disclosed herein, the specific shape, beveling, thicknesses, slopes, relative thicknesses, and the like may be modified or changed. For example, the anodes (e.g., 132, 232, 432, 532, 632) need not be thinner at the periphery, include any beveling or inflection points, or indeed even be disc-shaped. That is, the principles of heat distribution and weight reduction taught herein may be applied to any shape of anode.

Returning to FIG. 6, the region 653 closest to the center of the anode 632 is flat, but the surface 650 begins to slope at an inflection point 654 and continues in the sloped trajectory until the edge of the anode 632. In the center of the anode 632 is a center cavity 646 through which a shaft connected to a rotating motor can penetrate. The section of the crystalline ceramic body 640 that most closely surrounds the center cavity 646 can form an indented rim 644 around the center cavity 646 to contribute to the stability and/or functionality necessary for rotation of the anode 632.

The film 680 that completely encapsulates the crystalline ceramic body 640 may comprise a refractory metal. Electrons from an electron beam impinge the surface 650 of the anode 632 at the focal track, which is located on the film 680. The received electrons produce an increase in thermal energy in the film 680. The increase in thermal energy from the film 680 can be transferred or diffused to the crystalline ceramic body 640 so that the crystalline ceramic body 640 is hot enough to conduct electricity and/or thermal energy. The film 680 can be thermally coupled to the ceramic body 640.

Figure 7:
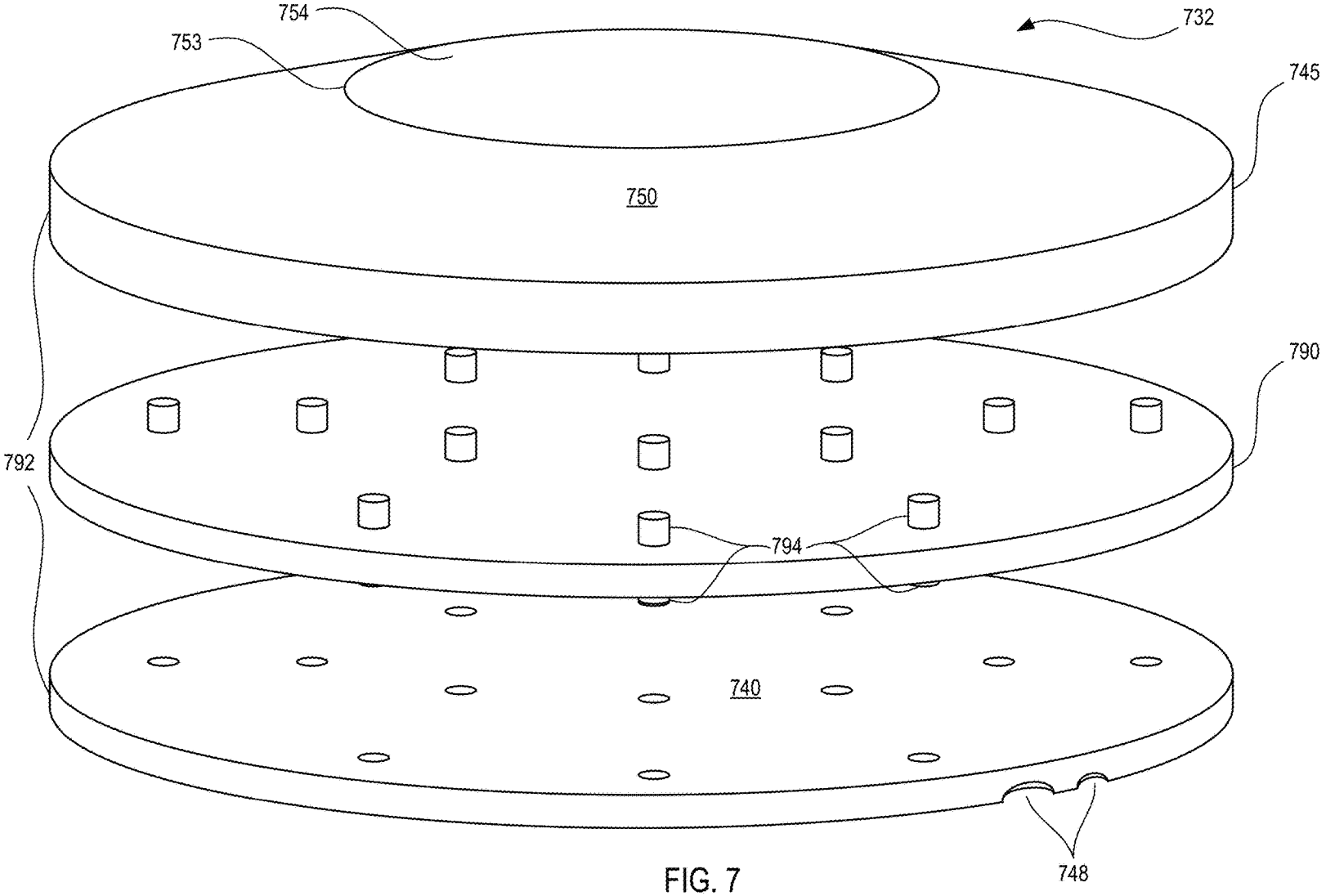
FIG. 7 illustrates a side view of an anode for an X-ray tube, according to one embodiment, that is separated into three layers to show a metal layer located between two crystalline ceramic layers.

FIG. 7 illustrates a side view of an anode 732 for an X-ray tube, according to one embodiment, that is separated into three layers to demonstrate a metal layer 790 located in the middle of two crystalline ceramic layers 792. The illustrated embodiment does not show a center cavity. In such an embodiment, a rotating shaft may be connected to the bottom layer 740. In other embodiments, a center cavity may be formed to facilitate the connection of a rotating shaft.

The metal layer 790 includes metal protrusions 794 directed toward both the top and bottom crystalline ceramic layers 792. The top and bottom crystalline ceramic layers 792 are perforated with holes so that the protrusions 794 of the metal layer 790 can connect with the crystalline ceramic layers 792.

The crystalline ceramic body of the base layer 740 can have one or more notches 748 forming an indentation on the outside edge of the base of the anode 732. The notches 748 on the base of the anode 732 can vary in depth and breadth and may be positioned so as to balance the weight of a spinning anode 732.

The surface 745 of the anode 732, forming the top crystalline ceramic layer 792, comprises a beveled surface 750 that slopes down and away from the flat surface 754 at the center of the anode 732 such that the depth of the crystalline ceramic body is thinner at the periphery than the interior of the anode 732. The region 754 closest to the center of the anode 732 is flat, but the surface 750 begins to slope at an inflection point 753 and continues in the sloped trajectory until the edge of the anode 732.

In various embodiments, one or more of the layers of the anode 732 may be made from or include as a coating, doping material, or two-part construction material one or more of: titanium diboride, boron carbide, titanium suboxide, reaction-bonded silicon carbide, and reaction-bonded silicon nitride. In various embodiments, a aperture may be performed to accommodate a shaft of a motor and/or other mechanical connection devices may be used on the underside of the layer 740 and/or within layers 740 and 790 to allow the anode 732 to be secured for rotation.

Figure 8:
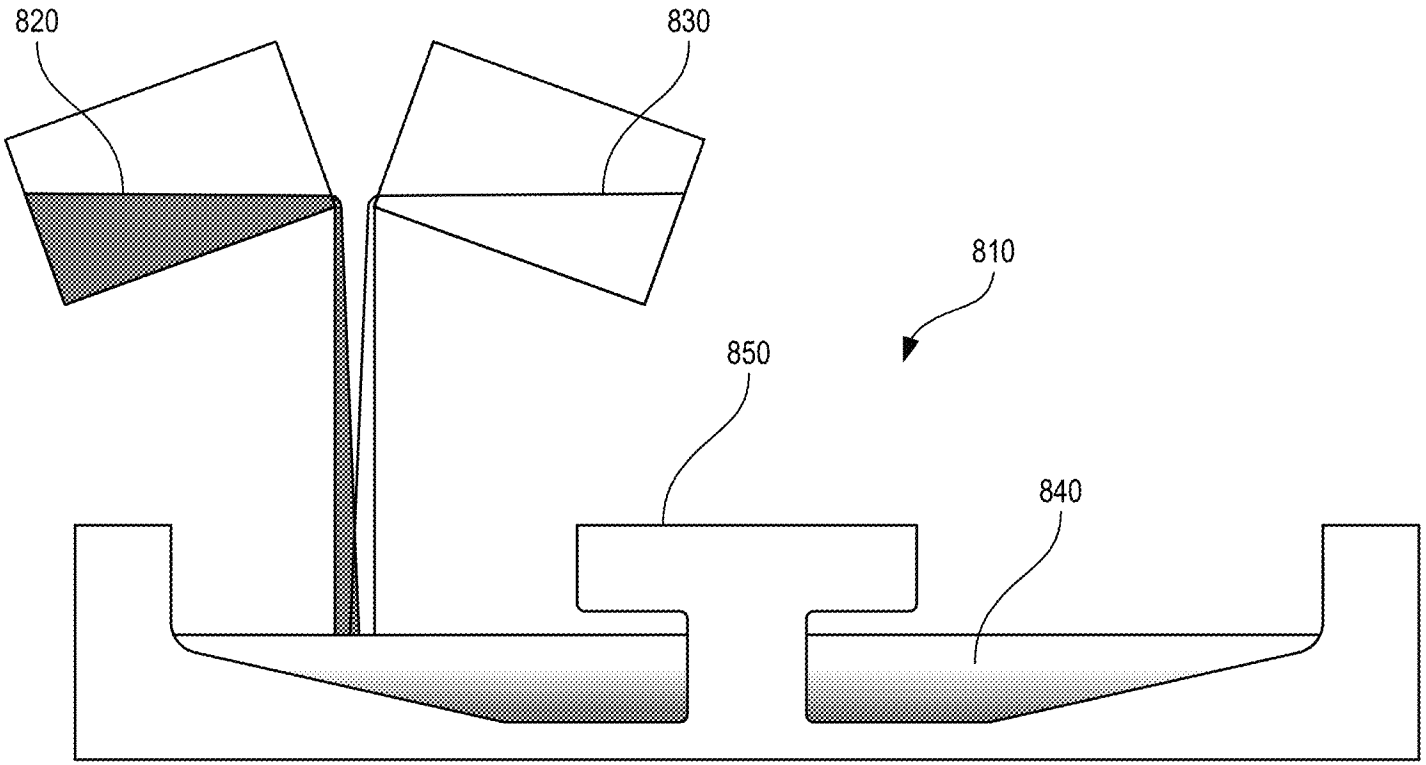
FIG. 8 illustrates an embodiment where metal and ceramic are combined to form an X-ray anode element comprising a gradient of metal and ceramic.

FIG. 8 illustrates an embodiment where metal 820 and ceramic 830 are combined in mold 850 to form an anode element 810 comprising a gradient of metal and ceramic 840. While this figure is illustrative of one embodiment of the concept of mixing metal and ceramic to form an appropriate gradient of material, there are numerous ways in which this process can be accomplished.

For example, one technique combines ceramic casting, etching, machining, and/or 3-D printing with metal pouring or deposition. A ceramic substrate can be cast, etched, machined, and/or 3-D printed in such a way that when metal is later added to its surface, the ratio of metal to ceramic is higher as it approaches the refractory surface of the anode. Additionally, the pouring of powders in the proper ratio with and/or without a melting, sintering, and/or annealing period between layers could be used. Another example forms a composite gradient by combining liquids of the materials in the proper ratio with and/or without a cooling period between layers of material. This is not intended to be an exhaustive list of approaches for creating an appropriate composite gradient, but rather a brief list of well understood approaches.

Figure 9A:
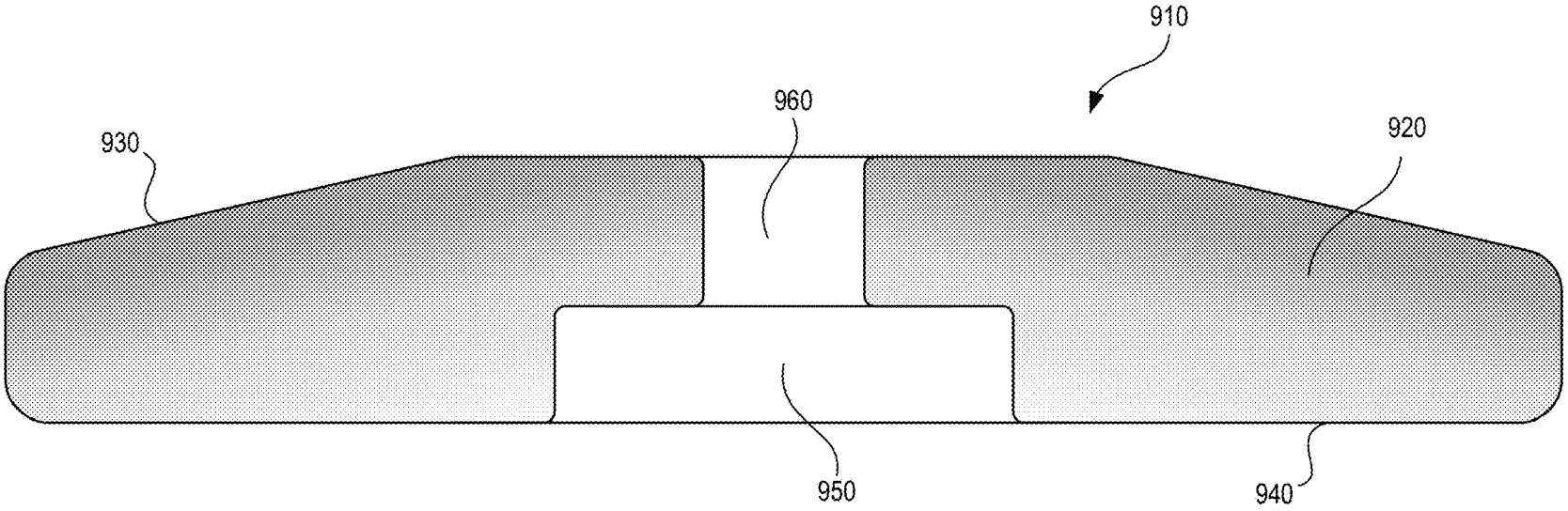
FIG. 9A is a side cross-sectional view of an anode for an X-ray tube, according to one embodiment, in which metal and ceramic are combined to form a vertical composite gradient of varying densities.

FIG. 9A is a side cross-sectional view of an anode 910 for an X-ray tube, according to one embodiment, in which metal and ceramic are combined to form a vertical composite gradient 920. The refractory surface 930 of the anode is primarily and/or entirely comprised of metal, such as molybdenum. In other embodiments, a molybdenum alloy may be utilized and/or molybdenum at locations of electron incidence may be used with another metal (e.g., tungsten) at other surface locations. Surface 940 is primarily and/or entirely comprised of ceramic in some embodiments. The metal within the composite gradient conducts heat away from the refractory surface into the ceramic. When sufficiently heated, the ceramic becomes conductive, increasing its contribution to heat dissipation. Cavities 950 and 960 facilitate mounting and rotation, respectively, of the anode within the X-ray tube. In some embodiments, the inner walls of cavities 960 and 950 may be substantially metal, substantially ceramic, and/or coated with anther material to ensure stability, strength and reduced wear and tear.

Figure 9B:
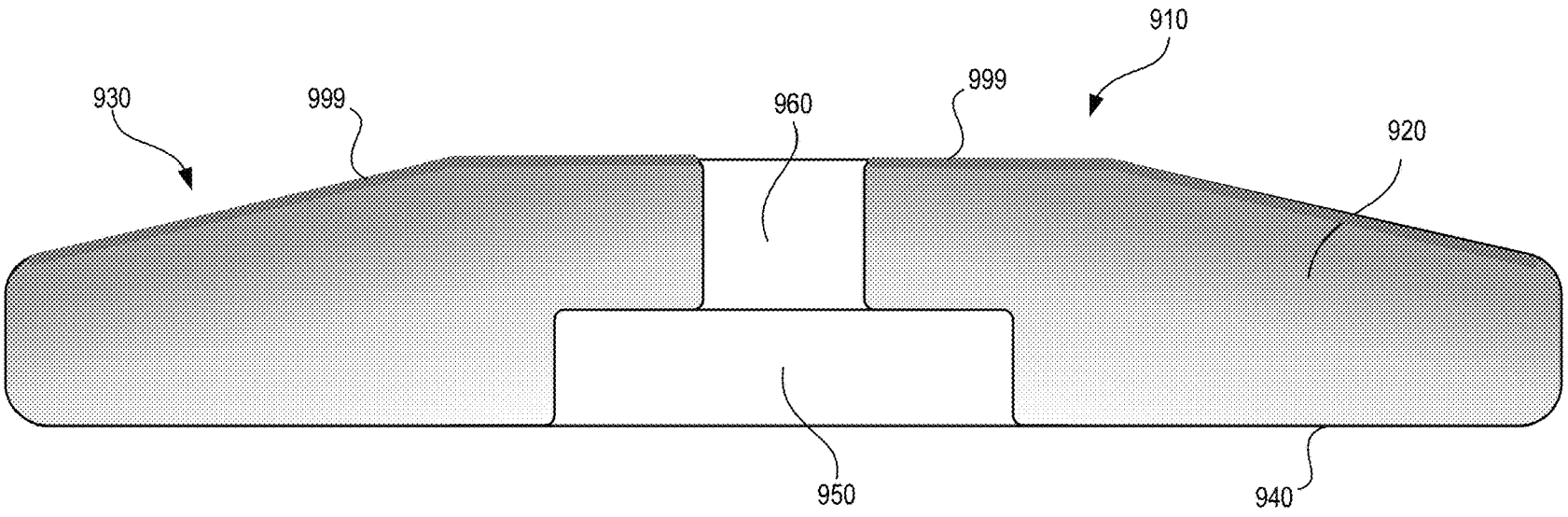
FIG. 9B is the side cross-sectional view of the gradient varying anode of FIG. 9A with a distinct layer of molybdenum on the surface of the anode.

FIG. 9B is the side cross-sectional view of the anode 910 of FIG. 9A with a distinct layer of molybdenum 999 on the surface of the anode 910. The reminder of the anode 910 may include metal and ceramic combined to form a vertical composite gradient 920. The metal used for the gradient may be any conductive (e.g., thermally and/or electrically conductive) metal suitable to provide thermal dissipation, withstand the high temperatures, have a high enough heat capacity, and/or otherwise provide the functionalities described herein. In other embodiments, the molybdenum layer 999 may only be on the angled surface 930 and/or only where electron beam incidence is expected.

Figure 10:
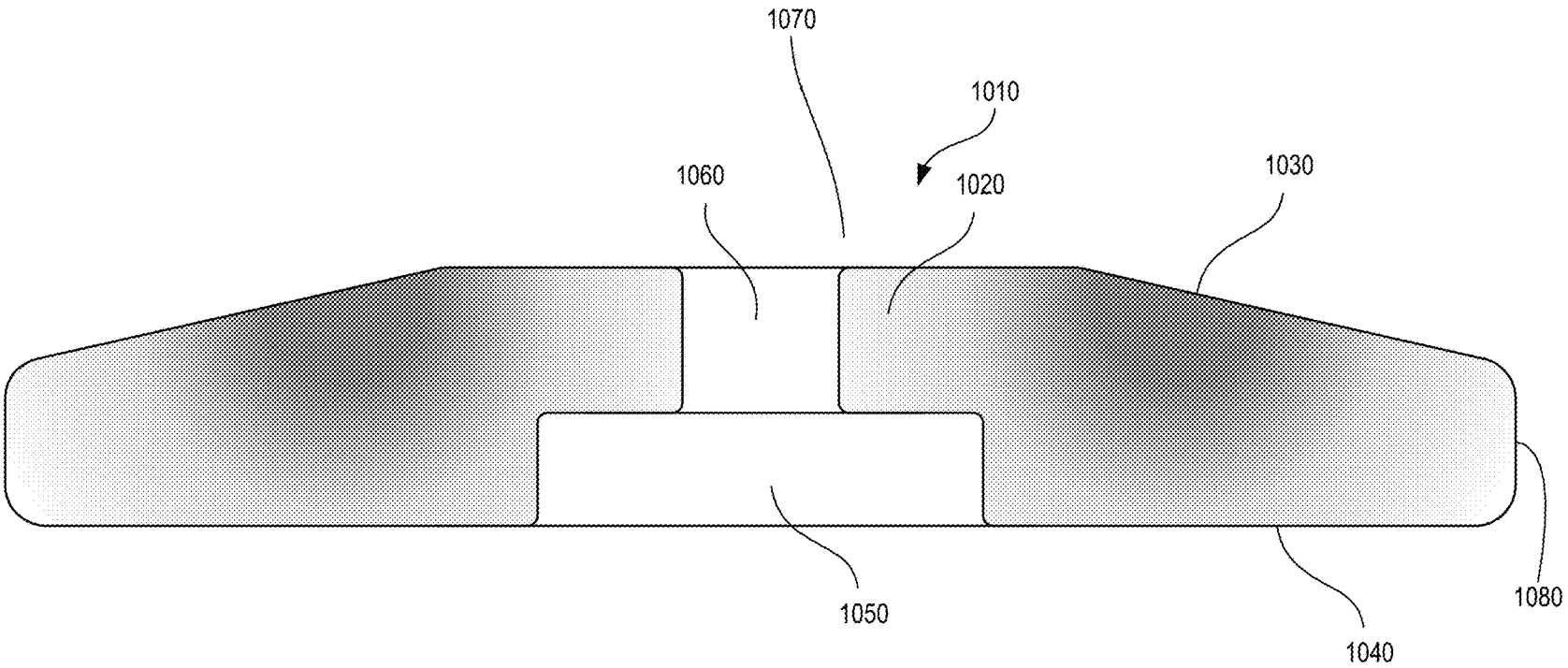
FIG. 10 is a side cross-sectional view of an anode for an X-ray tube, according to one embodiment, in which metal and ceramic are combined to form a composite gradient distribution that emanates from the surface proximate the focal track where the ratio of metal to ceramic is highest and decreases in all directions.

FIG. 10 is a side cross-sectional view of an anode 1010 for an X-ray tube, according to one embodiment, in which metal and ceramic are combined to form a composite gradient 1020 that emanates from the surface proximate the focal track 1030 where the ratio of metal to ceramic is highest and decreases in all directions. In the vertical direction, the gradient varies from primarily and/or entirely metal at the focal track 1030 to primarily and/or entirely ceramic at surface 1040. In the horizontal direction, the gradient varies from primarily and/or entirely metal at the focal track 1030 to primarily and/or entirely ceramic at the inside edge 1070 and outside edge 1080 of the anode 1010.

Electrons from an electron beam impinge the focal track 1030 of the anode 1010 that heats the focal track surface. The metal within the composite gradient conducts heat away from the focal track 1030 into the ceramic. When sufficiently heated the ceramic becomes conductive, increasing its contribution to heat dissipation. Cavities 1050 and 1060 facilitate mounting and rotation, respectively, of the anode 1010 within the X-ray tube.

Any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims. Elements recited in means-plus-function format are intended to be construed in accordance with 35 U.S.C. § 112(f).

This disclosure has been made with reference to various embodiments, including the best mode. However, those skilled in the art will recognize that changes and modifications may be made to the embodiments without departing from the scope of the present disclosure. While the principles of this disclosure have been shown in various embodiments, many modifications of structure, arrangements, proportions, elements, materials, and components may be adapted for a specific environment and/or operating requirements without departing from the principles and scope of this disclosure. These and other changes or modifications are intended to be included within the scope of the present disclosure.

This disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element. The scope of the present invention should, therefore, be determined by the following claims:

What is claimed is:

1. An X-ray anode, comprising:

a ceramic body that, at least in a thermally excited state, emits X-rays in response to incident electrons from an electron beam, and for at least a first temperature range, increases in thermal conductivity with increased temperature; and a gradient distribution of one or more conductive metals within the ceramic body to facilitate thermal distribution within the ceramic body, wherein thermal energy from a plurality of received incident electrons is distributed throughout the ceramic body via the distributed conductive metals, such that the temperature of the ceramic body increases as does the thermal conductivity of the ceramic body for at least the first temperature range.

2. The X-ray anode of claim 1, further comprising an outer layer of molybdenum on at least one surface to receive incident electronics from the electron beam and generate x-rays.

3. The X-ray anode of claim 1, wherein the gradient distribution of one or more conductive metals decreases in percentage from a surface of electron incidence to an opposing surface.

4. The X-ray anode of claim 1, wherein the gradient distribution of one or more conductive metals decreases in percentage from a ring of electron incidence on a surface of the ceramic body with respect to distance.

5. The X-ray anode of claim 1, wherein the gradient distribution of one or more conductive metals comprises a gradient distribution of a single metal.

6. The X-ray anode of claim 1, wherein the gradient distribution of one or more conductive metals comprises a gradient distribution of multiple metals.

7. The X-ray anode of claim 1, wherein the gradient distribution of one or more conductive metals comprises a gradient distribution of a metal powder within the ceramic body.

8. The X-ray anode of claim 1, wherein a thermally unexcited state comprises temperatures below approximately 100 degrees Celsius.

9. The X-ray anode of claim 1, wherein the first temperature range, in which thermal conductivity increases as temperature increases, includes temperatures between 30 degrees Celsius and 500 degrees Celsius.

10. The X-ray anode of claim 1, wherein the density of the gradient distribution of one or more conductive metals is highest at locations where the electron beam strikes a surface of the ceramic body.

11. The X-ray anode of claim 10, wherein the one or more conductive metals are exposed at locations where the electron beam strikes the surface of the ceramic body.

12. The X-ray anode of claim 1, further comprising an aperture through which a shaft can be connected to rotate the X-ray anode during operation.

13. The X-ray anode of claim 1, wherein the ceramic body comprises yttrium oxide.

14. The X-ray anode of claim 1, further comprising a metal backing fixed to one of:

a surface that receives the incident electrons from the electron beam, and a surface opposite the surface that receives the incident electrons from the electron beam.

15. An X-ray anode, comprising:

a ceramic body that conducts electrons and emits X-rays in response to the incidence of the electrons when in a thermally excited state; and a gradient distribution of a conductive metal within the ceramic body to distribute thermal energy from an incident electron beam to the ceramic body, wherein the received electrons produce an increase in thermal energy distributed within the ceramic body via the gradient distribution of conductive metals.

16. The X-ray anode of claim 15, further comprising an outer layer of molybdenum on at least one surface to receive incident electronics from the electron beam and generate x-rays.

17. The X-ray anode of claim 15, further comprising a conductive metal film fused to a surface of an electron beam-receiving portion of the ceramic body.

18. The X-ray anode of claim 15, wherein the ceramic body further comprises a track at least where the electron beam strikes the X-ray anode, and wherein the metal film is contained within the track.

19. An X-ray anode, comprising:

a ceramic body that conducts electrons and emits X-rays in response to incident electrons when in a thermally excited state; and a conductive metal deposited within the ceramic body according to a gradient density profile of the conductive metal, wherein locations configured to receive electrons from an electron beam have a maximum density of the conductive metal, and wherein the density of the conductive metal decreases with respect to distances therefrom, wherein received electrons produce an increase in thermal energy in the deposited conductive metal, and the deposited conductive metal diffuses the increase in thermal energy to the ceramic body at rates corresponding to the gradient density profile.

20. The X-ray anode of claim 19, further comprising an outer layer of molybdenum on at least one surface to receive incident electronics from the electron beam and generate x-rays.

* * * * *